US005170874A

United States Patent [19]

Abe

[11] Patent Number: 5,170,874

[45] Date of Patent: Dec. 15, 1992

[54] COIN CONVEYOR FOR SUCCESSIVELY TRANSPORTING COINS

[75] Inventor: Hiroshi Abe, Tokyo, Japan

[73] Assignee: Asahi Seiko Kabushiki Kaisha, Tokyo, Japan

[21] Appl. No.: 737,343

[22] Filed: Jul. 29, 1991

[30] Foreign Application Priority Data

Aug. 2, 1990 [JP] Japan ..... 2-203988
Dec. 20, 1990 [JP] Japan ..... 2-417960

[51] Int. Cl.[5] ..... G07D 1/00

[52] U.S. Cl. ..... 194/344; 453/57; 221/267; 193/DIG. 1

[58] Field of Search ..... 194/343, 344; 193/25 A, 193/25 S, 25 FT, 25 E, DIG. 1, 35 R, 35 B, 35 C; 221/267, 308; 453/57, 63

[56] References Cited

U.S. PATENT DOCUMENTS

| | | | |
|---|---|---|---|
| 3,460,661 | 8/1969 | Albright et al. | 194/344 X |
| 3,837,454 | 9/1974 | Joeck | 194/344 X |
| 4,437,478 | 3/1984 | Abe . | |
| 4,890,714 | 1/1990 | Brown | 193/35 R |

*Primary Examiner*—F. J. Bartuska
*Attorney, Agent, or Firm*—Nilles & Nilles

[57] ABSTRACT

A coin conveyor for successively transporting coins comprises an elongated back plate and a plurality of tapered guide rollers arranged at respective opposite side edge portions of the back plate so as to guide and retain coins transported on the back plate.

10 Claims, 8 Drawing Sheets

COIN CONVEYOR FOR SUCCESSIVELY TRANSPORTING COINS

BACKGROUND OF THE INVENTION

1. Field of the Invention

The present invention relates to a coin conveyor such as a coin escalator or the like for successively transporting coins dispensed or delivered from a coin payout hopper in an automatic bending machine, automatic payout machine, coin exchanger, game machine or the like.

2. Related Art Statement

Hitherto, there is a coin payout hopper as described in U.S. Pat. No. 4,437,478 and as shown in FIG. 1 comprising a hopper 1 for storing coins A in bulk, and a coin feeding rotary disc 2 rotatably mounted within the hopper at an angle to the horizontal. The rotary disc 2 has a central shelf 3 and a plurality of delivery pins 4 spaced in the peripheral direction of the rotary disc and extended from the surface of the rotary disc to define a plurality of coin pockets for picking up a coin from the hopper lower portion and feeding the coin to an upper delivery portion by the respective coin pocket upon rotation of the rotary disc. The coin payout hopper further comprises an outlet chute 5 for receiving coins discharged from the upper delivery portion and for dispensing coins one at a time by a pushing force of the delivery pin or a coin counting switch actuating roller B.

Some coin payout hoppers of the type mentioned above are provided with an outlet device as shown in FIG. 1 comprising an escalator 6 connected to the upper end of the outlet chute 5 at the lower end thereof and upwardly extended from the outlet chute 5 for transporting coins to a coin tray (not shown) which is elevated from the hopper mounted on a bottom plate in for example a coin changer, game machine or the like.

The coin escalator 6 is an example of a coin conveyor in the form of an elongated trough composed of front and back side plates 7 and 8 and a pair of edge plates 9 interposed between the side edges of the side plates, respectively, for spacing the side plate by a distance corresponding to a thickness of the coin to be transferred to define a coin passage 10.

As mentioned above, the coin escalator 6 is connected to the upper end of the outlet chute 5 which receives coins delivered from the upper delivery portion of the rotary disc which is inclined at an angle to the horizontal in the coin payout hopper. Thus, the coin escalator 6 may be upwardly extended at an angle from the upper end of the outlet chute 5 up to a height of more than two meters in case of a game machine. In such a case, the coin escalator may be bent from the inclined lower end portion **6*a* to the vertically extending portion 6*b* through a curved portion 6*c*** in order to decrease a space depth required for the coin escalator.

When the escalator 6 is provided with a curved portion **6*c* to change the direction of transferring coin, if the curved portion 6*c* has a large radius of curvature as shown in FIG. 2, the distance between the front and back side plates 7 and 8 in the curved portion 6*c* can be 0.2 to 0.5 mm more than a thickness of the coin to be transferred similar to that in the straight portions 6*a* and 6*b* in order to pass the coin through the curved portion 6*c*** without dragging of coins and/or jamming, but a large space as shown by a dimension D-1 is required for changing of direction, in particular when the transferring direction of the coin transporting duct or the like is changed by a right angle.

On the other hand, if the curved portion **6*c* is bent with a small radius of curvature as shown in FIG. 3 because of a limited space, the distance between the front and back side plates 7 and 8 in the curved portion 6*c* must be incleased as shown by "d" so as to easily pass coins through the curved portion. As a result, one of the successive coins A and B can overlap on the other to be dragged and/or jammed in the curved portion 6*c***.

Hitherto, a leaf spring 11 has been used to urge a coin against the side plate 7 in the curved portion **6*c* as shown in FIGS. 1 and 4. Such a leaf spring however could not completely prevent coins from overlapping in the coin passage 10**.

SUMMARY OF THE INVENTION

An object of the invention is to provide a coin conveyor adapted for smoothly guiding and retaining coins in curved portions as well as straight portions so as to be transported without coin dragging or jamming regardless of dimensions of radius of curvature of the curved portion.

According to the present invention, as shown in FIGS. 5 and 6, a coin conveyor comprises an elongated back plate 8 and a plurality of tapered guide rollers 12 arranged along respective opposite side edge portions **8*a* and 8*a* of the back plate 8 so as to guide and retain coins transported on the back plate 8**.

The back plate may be a curved elongated plate or a straight elongated plate.

In a preferred embodiment, each of the tapered guide rollers 12 is rotatably supported on a spring loaded roller shaft 15 which is perpendicularly extended through the back plate 8 and has an inverted conical surface 13 opposed to the front surface **8*b* of the back plate 8, whereby engaging with the coin edge to resiliently retain the transporting coin on the back plate as shown in FIGS. 7 and 8**.

In a preferred embodiment, as shown in FIG. 7, a spring 17 is interposed between the rear surface **8*c* of the back plate 8 and an extended end 15*a* of the roller shaft 15, so that the tapered guide roller 12 is resiliently movable in a direction of the axis of the roller shaft 15 on the side of the front surface of the back plate 8**.

In another embodiment, as shown in FIG. 8 a tension spring 22 is interposed between the extended ends of roller shafts 15, 15 of a pair of opposed tapered guide rollers 12 and 12. The roller shafts of the opposed tapered guide rollers are movable in a lateral direction in respective slots 20, 20 formed in the base plate 8, so that the tapered guide rollers 12, 12 are resiliently movable toward and away from each other.

The tapered surface of the guide roller may be semi-pherical surface.

According to the aforementioned arrangement of the present invention, when coins are successively transported on the back plate by pushing force of the coin feeding pins on the rotary disc rotating in the payout hopper, each coin passes between a pair of left and right opposed tapered guide rollers against spring force of springs 17, 17 or 22 so that the downward tapered surfaces of the opposed guide rollers resiliently engage the peripheral edge of the coin to retain the coin on the front surface of the back plate while the coin non-frictionally contacts with the tapered guide rollers so that coin is easily and smoothly transported on the back plate.

Moreover, when the payout hopper is stopped and the coins in the coin escalator are not subjected to any push up force applied by following coins, the coins in the coin escalator are retained on the back plate by the spring force acting on the tapered guide rollers.

Furthermore, when the coin passage is jammed by a deformed coin or deposited dust, such a deformed coin or deposited dust can be easily removed by simply detaching one or two tapered guide rollers from the back plate. On the other hand, the conventional coin conveyor composed of a back plate, side edge plates and front plates is required to disassemble at least one of the long front plates and remove some of coins from the coin passage in order to remove the deformed coin or deposited dust.

DESCRIPTION OF THE PREFERRED EMBODIMENTS

The present invention will now be more fully described with reference to FIGS. 5–12.

Figure 1:
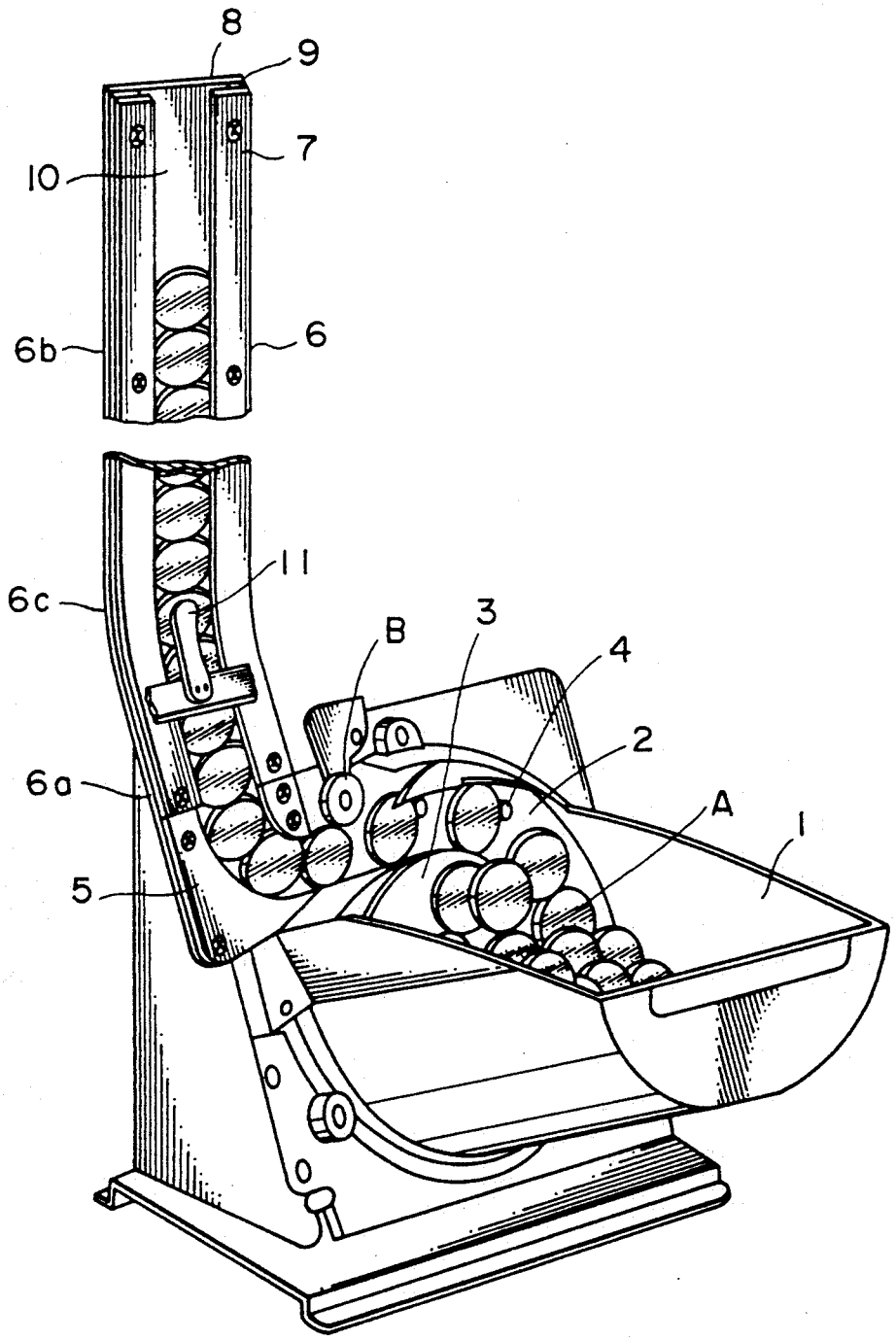
F I G . 1 PRIOR ART
FIG. 1 is a schematic perspective view illustrating a conventional coin payout hopper provided with a coin escalator.
Figure 2:
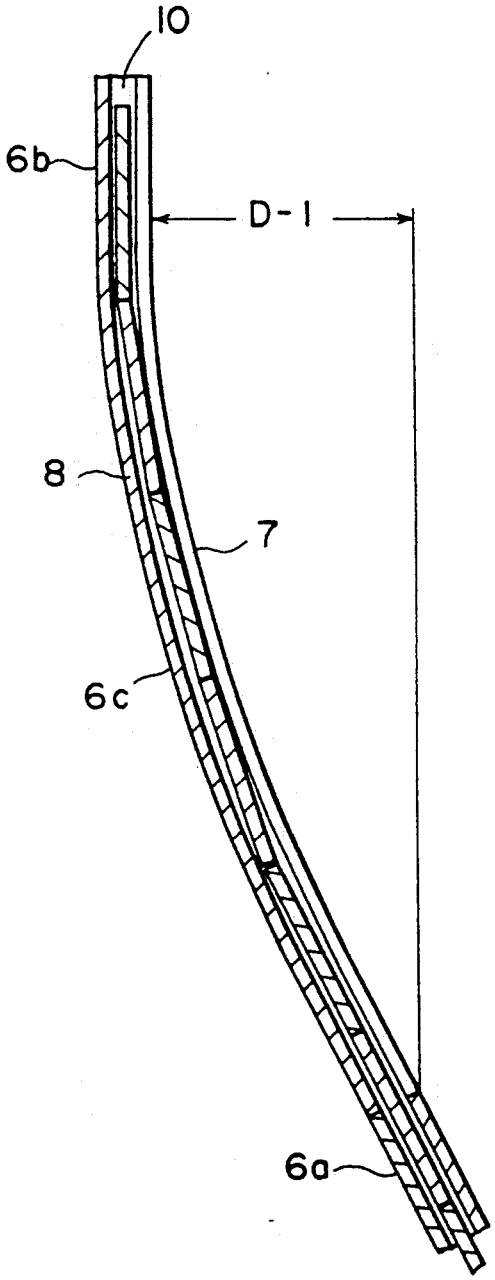
FIG. 2 PRIOR ART
FIG. 2 is a schematic sectional view of a conventional coin escalator having a curved portion of a large radius of curvature.
Figure 3:
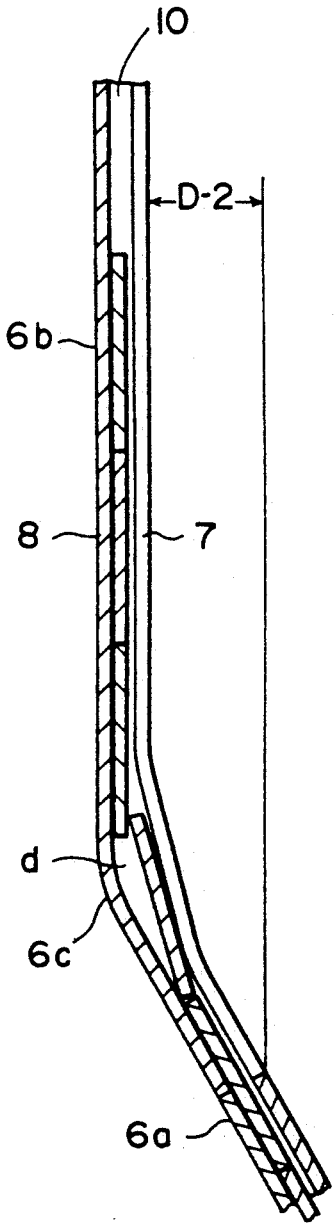
FIG. 3 PRIOR ART
FIG. 3 is a schematic sectional view of a conventional coin escalator having a curved portion of a small radius of curvature.
Figure 4:
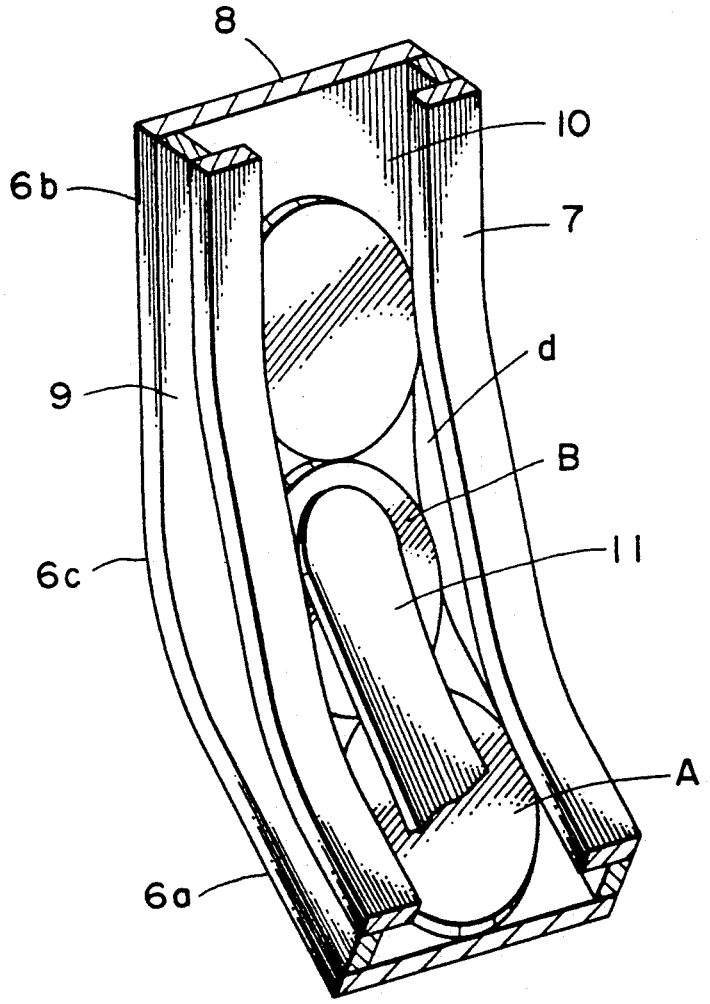
F I G . 4 PRIOR ART
FIG. 4 is an enlarged schematic perspective view of a curved portion of the conventional coin escalator shown in FIG. 1.
Figure 5:
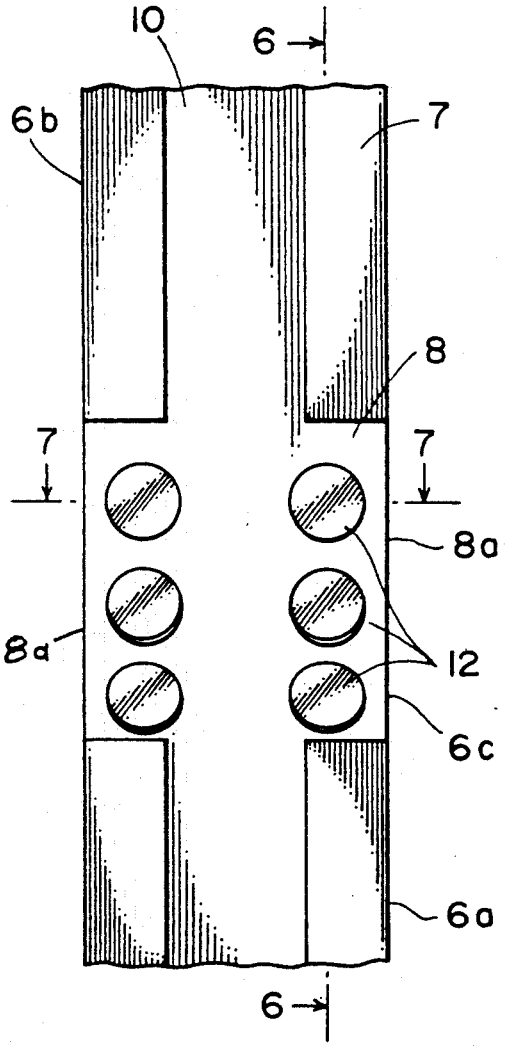
FIG. 5 is a front view of a portion of an embodiment of a escalator according to the present invention.
Figure 6:
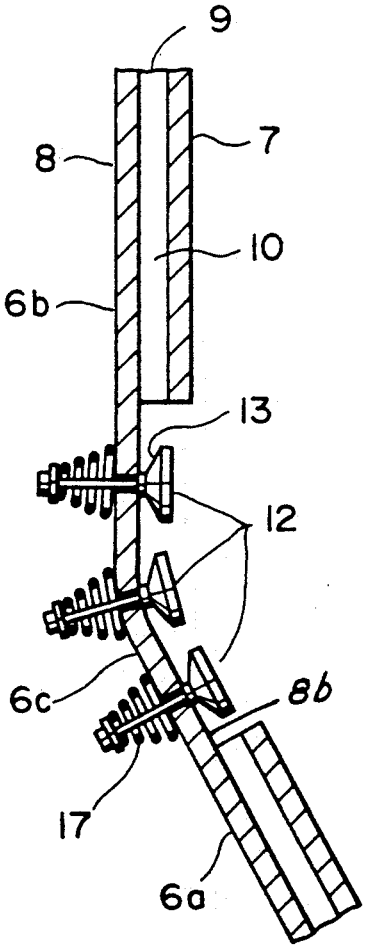
FIG. 6 is a vertical sectional view of the escalator taken alone line 6—6 in FIG. 5.
Figure 7:
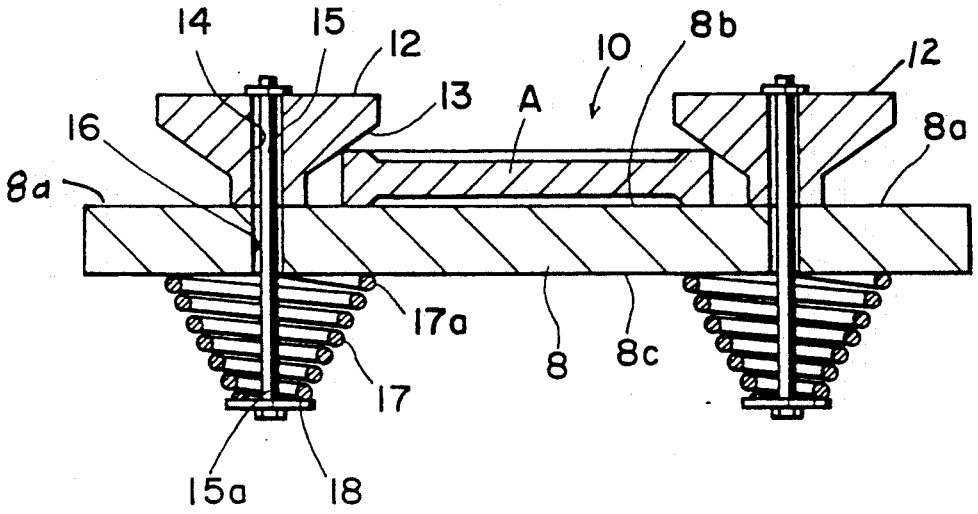
FIG. 7 is a cross sectional view of the escalator taken along line 7—7 in FIG. 5.

Referring to FIGS. 5–7 illustrating one embodiment of a coin escalator according to the present invention having an inclined lower end portion 6*a* having a coin passage 10 which is conventionally defined by a portion of an elongated back plate 8, a pair of opposed edge plates 9 and front plates 7; a curved portion 6*c* which is composed of a portion of the elongated back plate 8 and a plurality of tapered guide rollers 12 loaded by respective springs 17 and arranged along respective opposite side edges 8*a*, 8*a* of the back plate 8 so as to guide and retain coins transported in the coin passage 10 on the back plate 8; and a vertically extending portion 6*b* which is also conventionally composed by a portion of the elongated back plate 8, a pair of opposed edge plate 9 and front plates 7.

Figure 9:
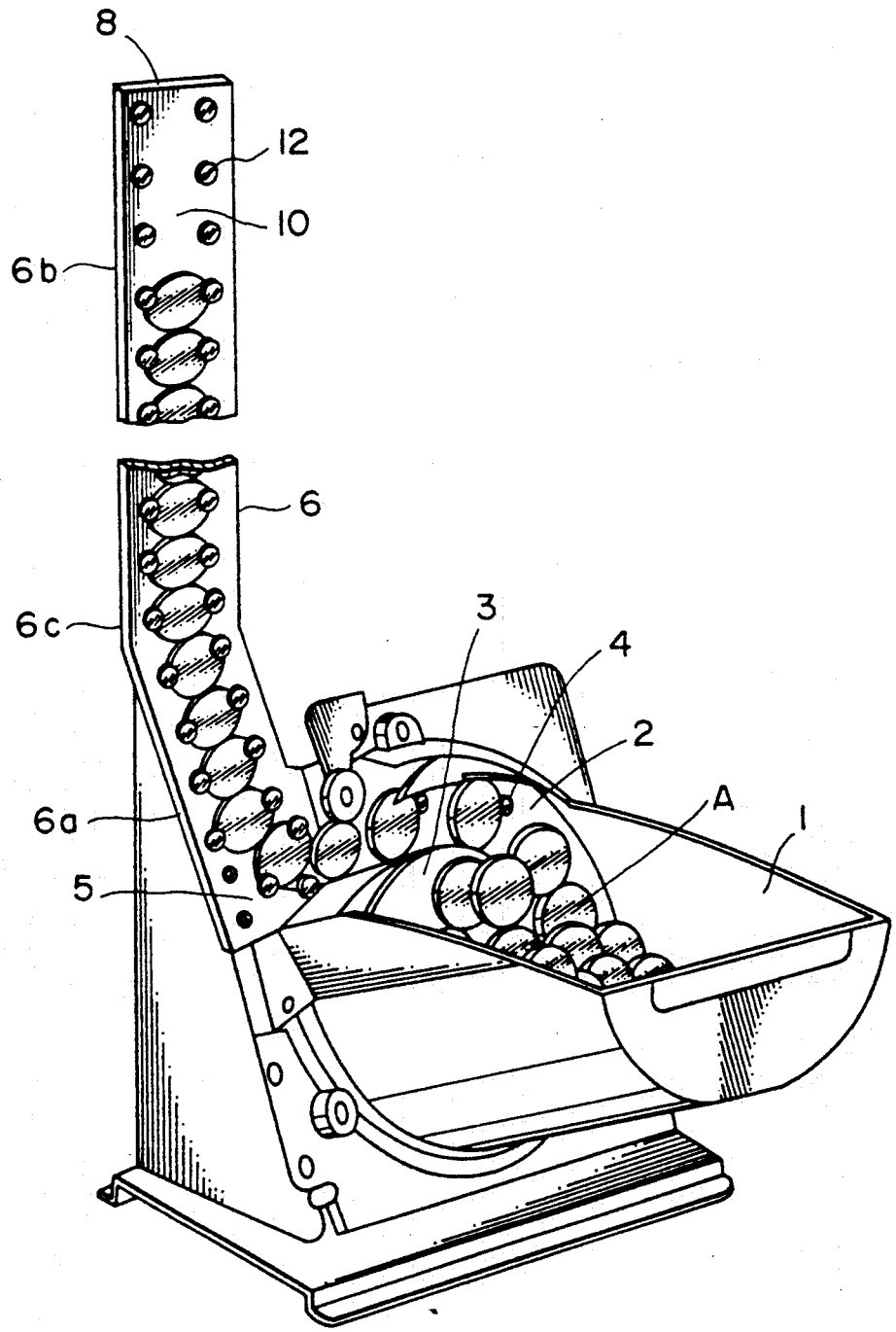
FIG. 9 is a schematic perspective view illustrating another embodiment of the present invention.
Figure 10:
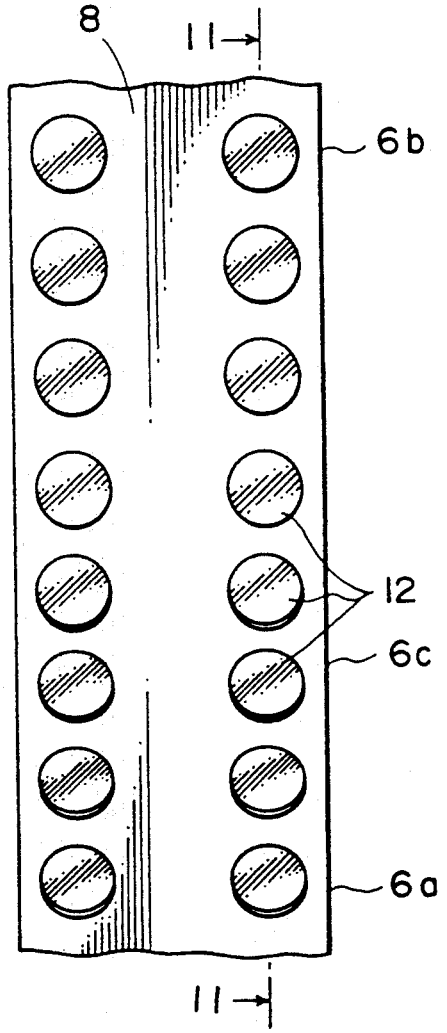
FIG. 10 is a front view of a curved portion of the coin conveyor shown in FIG. 9.
Figure 11:
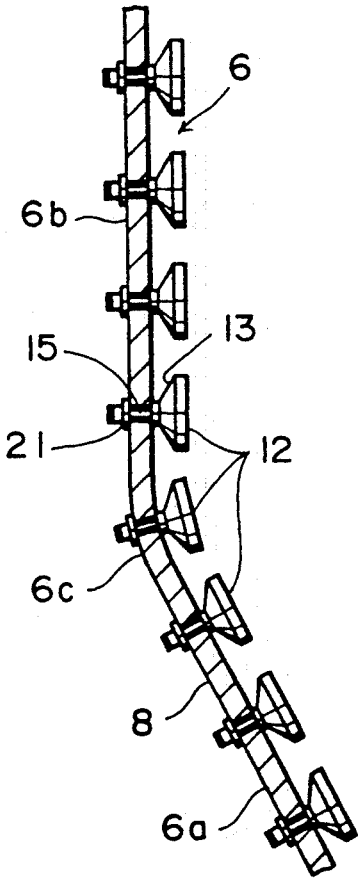
FIG. 11 is a sectional view taken along line 11—11 of FIG. 10.

In this embodiment, the tapered guide rollers are arranged only in the curved portion 6*c*, but may be also arranged in the inclined lower end portion 6*a* and the vertically extending portion 6*b* in place of the front and edge plates as shown in FIGS. 9–11.

The tapered guide roller 12, as shown in FIG. 7, has an inverted conical surface 13 and a central through hole 14 through which is extended a roller shaft 15 so that the tapered guide roller 12 is rotatably supported on the roller shaft 15. The roller shaft 15 is extended through a hole 16 formed in the back plate 8. A spiral spring 17 is interposed between the rear surface 8*c* of the back plate 8 and a spring seat 18 secured to the extended end of the roller shaft 15.

With the aforementioned arrangement of the spring loaded tapered guide rollers 12, a coin A pushed up to the curved portion 6*c* of the coin escalator 6 by the following coins enters between a pair of the left and right tapered guide rollers 12 as shown in FIG. 7 against the spring force of the spiral springs 17 and engages with the downward faced inverted conical surface 13 at the peripheral edge of the coin A to be urged to the front surface of the back plate 8. Thus the coin transported in the curved portion 6*c* is resiliently retained on the front surface of the back plate 8.

Figure 8:
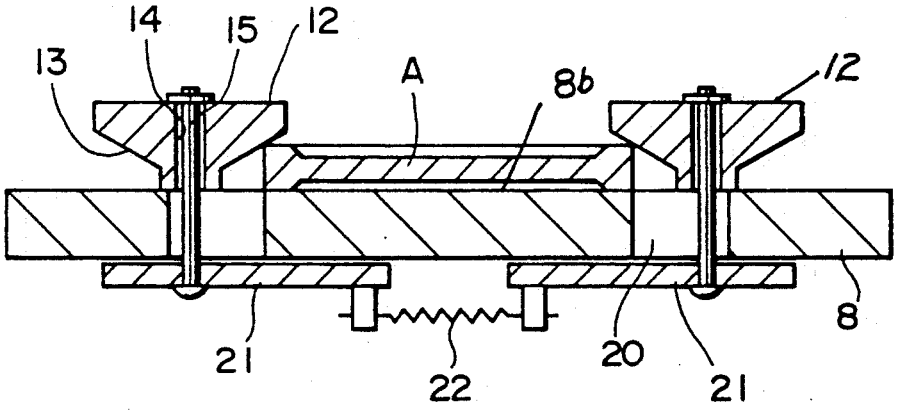
FIG. 8 is a cross sectional view of another embodiment of the escalator according to the present invention.

FIG. 8 illustrates another embodiment of the present invention. In this embodiment, the roller shafts 15 and 15 of a pair of opposed tapered guide rollers 12 and 12 are extended through respective slots 20 and 20 formed in the back plate 8 and are secured at the extended ends to respective slide plates 21 and 21 which are connected by a tension spring 22 so that the opposed tapered guide rollers 12 and 12 can be moved toward and away from each other in the lateral direction, that is in a direction of width of the back plate 8 when a coin passes between the opposed tapered guide rollers. In this embodiment, when a coin enters between the tapered guide rollers at the opposited side edge portions, the coin also is subjected to a downward urging force so as to be resiliently retained on the front surface 8*b* of the back plate by the action of the tapered surfaces.

Referring to FIGS. 9–11 illustrating another embodiment of the invention, a plurality of tapered guide rollers 12 are arranged in both the side edge portions of the back plate 8 and spaced to each other along the side edge over the whole length thereof.

Figure 12:
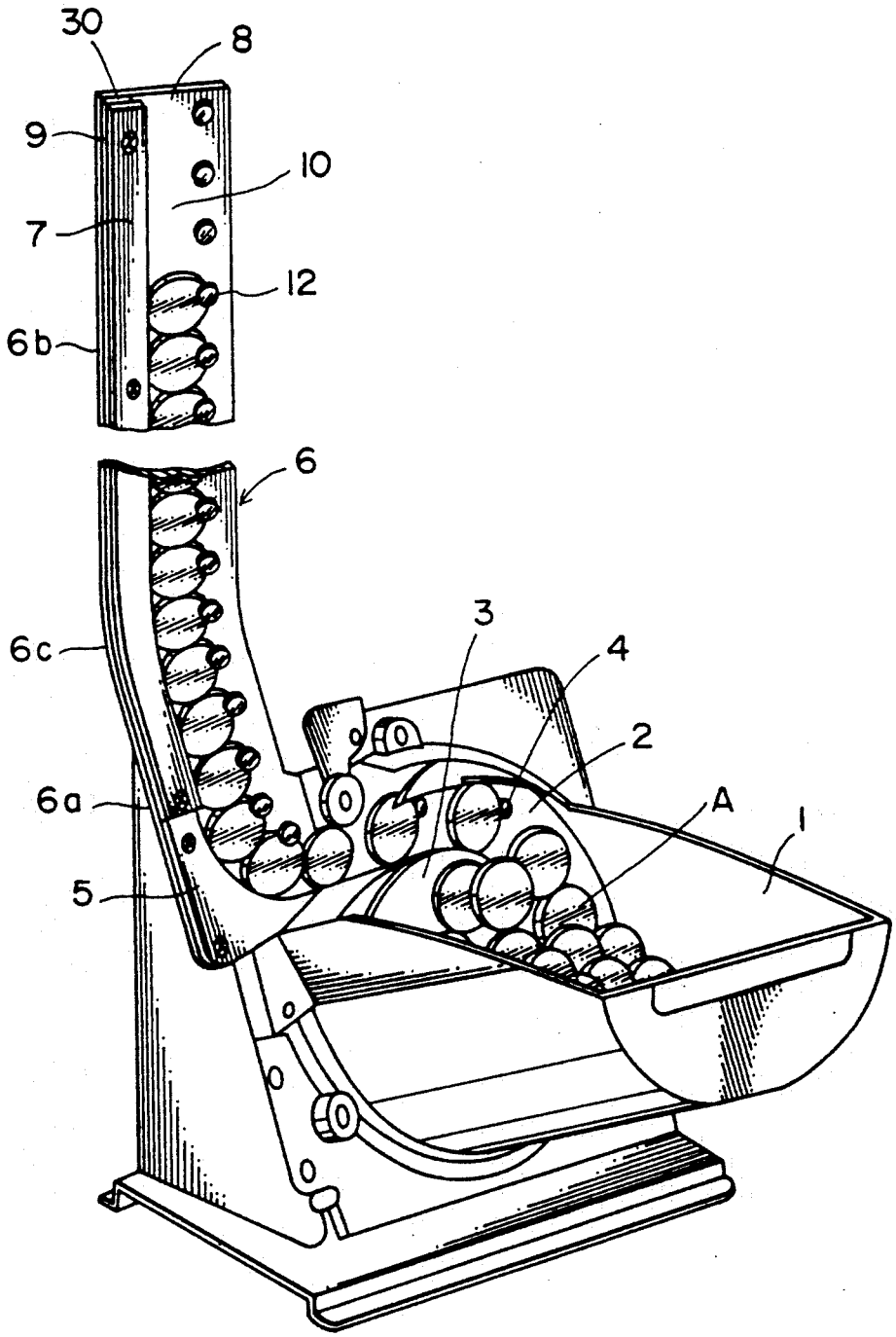
FIG. 12 is a schematic perspective view illustrating another embodiment of the present invention.

Referring to FIG. 12 illustrating further embodiment of the invention; a plurality of tapered guide rollers 12 are arranged in one side edge portion of the back plate 8 and spaced to each other along the side edge over the whole length thereof. In the other side edge portion there is a guide groove 30 formed by an edge plate 9 and a front plate 7 for guiding a half portion of a coin.

What is claimed is:

1. A coin conveyor for successively transporting coins comprising an elongated back plate and a plurality of tapered guide rollers arranged at respective opposite side edge portions of the back plate so as to guide and retain coins transported on the back plate, wherein each tapered guide roller is rotatably supported on a spring loaded roller shaft which is perpendicularly extended through the back plate and has an inverted conical surface opposed to the front surface of the back plate, whereby engaging with the coin edge to resiliently retain the transporting coin on the back plate.

2. The coin conveyor claimed in claim 1, wherein the back plate is a curved elongated plate.

3. The coin conveyor claimed in claim 1, wherein the back plate is a straight elongated plate.

4. The coin conveyor claimed in claim 1, wherein a spring is interposed between the rear surface of the back plate and an extended end of the roller shaft, so that the tapered guide roller is resiliently movable in a direction of the axis of the roller shaft against spring force.

5. The coin conveyor claimed in claim 1, wherein a tension spring is interposed between extended ends of roller shafts of a pair of opposed tapered guide rollers and the roller shafts are movable in a lateral direction in respective slots in the back plate, so that the tapered guide rollers are resiliently movable toward and away from each other against spring force.

6. A coin conveyor for transporting coins comprising:

an elongated back plate having a front surface and a rear surface opposite to said front surface;

a plurality of tapered guide rollers being arranged on said front surface and each having an inverted conical surface opposed to said front surface, respectively; and a plurality of spring loaded roller shafts, one shaft rotatably supporting each of said tapered guide rollers on said front surface, respectively, to resiliently support each of said coins between said front surface and each of said inverted conical surface.

7. A coin conveyor as claimed in claim 6, wherein each of said spring loaded roller shafts has an extending end protruding from said rear surface through said front surface, and further comprising a plurality of compression springs each of which is interposed between said rear surface and said extending end, so that each of said tapered guide rollers is resiliently movable in a direction of the axis of each of said spring loaded roller shafts against compression spring force of its respective compression spring.

8. A coin conveyor as claimed in claim 6, wherein said plurality of spring loaded roller shafts are arranged in pairs and each has an extending end protruding from said rear surface through said front surface, respectively, and further comprising a plurality of tension springs each of which is interposed between said extending ends of each of said pairs, so that each of said tapered guide rollers is resiliently movable toward and away from each other against tension spring force of each of said tension springs.

9. A coin conveyor as claimed in claim 6, wherein said elongated back plate has a first and a second side edge portions, said first side edge portion being provided with said plurality of tapered guide rollers, said second side edge portion being provided with an elongated groove for supporting each of said coins in correspondence with each of said tapered guide rollers, said plurality of spring loaded roller shafts each having an extending end protruding from said rear surface through said front surface, respectively, and further comprising a plurality of tension springs each of which is interposed between each of said extending ends and said second side edge portion on said rear surface, so that each of said tapered guide rollers is resiliently movable toward and away from said elongated groove against tension spring force of each of said tension springs.

10. A coin conveyor for successively transporting coins comprising an elongated back plate having opposite side edge portions, a plurality of tapered guide rollers arranged along one of said side edge portions of the back plate so as to guide and retain coins transported on the back plate, wherein each tapered guide roller is rotatably supported on a spring loaded roller shaft which is perpendicularly extended through the back plate and has an inverted conical surface opposed to the front surface of the back plate, whereby engaging with the coin edge to resiliently retain the transporting coin on the back plate, the other side edge portion being provided with a groove for guiding a half side portion of a coin.

* * * * *